US008091609B2

(12) United States Patent
Aase et al.

(10) Patent No.: US 8,091,609 B2
(45) Date of Patent: Jan. 10, 2012

(54) METHOD OF FORMING CASTING WITH FRICTIONAL DAMPING INSERT

(75) Inventors: Jan H. Aase, Oakland Township, MI (US); Mark W. Verbrugge, Troy, MI (US); James G. Schroth, Troy, MI (US); Shung H. Sung, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1034 days.

(21) Appl. No.: 11/969,259

(22) Filed: Jan. 4, 2008

(65) Prior Publication Data

US 2009/0176122 A1 Jul. 9, 2009

(51) Int. Cl.
*B22D 19/00* (2006.01)
*B22D 19/02* (2006.01)
*B22D 19/16* (2006.01)

(52) U.S. Cl. ..... 164/98; 164/100; 164/112

(58) Field of Classification Search ..... 164/98, 164/100, 112
See application file for complete search history.

(56) References Cited

U.S. PATENT DOCUMENTS

| | | | |
|---|---|---|---|
| 974,024 | A | 10/1910 | Carter |
| 1,484,421 | A | 2/1924 | Thomspon |
| 1,989,211 | A | 1/1935 | Norton |
| 2,012,838 | A | 8/1935 | Tilden |
| 2,026,878 | A | 1/1936 | Farr |
| 2,288,438 | A | 6/1942 | Dach |
| 2,603,316 | A | 7/1952 | Pierce |
| 2,978,793 | A | 4/1961 | Lamson et al. |
| 3,085,391 | A | 4/1963 | Hatfield et al. |
| 3,127,959 | A | 4/1964 | Wengrowski |
| 3,147,828 | A | 9/1964 | Hunsaker |
| 3,292,746 | A | 12/1966 | Robinette |
| 3,378,115 | A | 4/1968 | Stephens, Ill |
| 3,425,523 | A | 2/1969 | Robinette |
| 3,509,973 | A | 5/1970 | Kimata |
| 3,575,270 | A | 4/1971 | Wagenfuhrer et al. |
| 3,774,472 | A | 11/1973 | Mitchell |
| 3,841,448 | A | 10/1974 | Norton, Jr. |
| 3,975,894 | A | 8/1976 | Suzuki |
| 4,049,085 | A | 9/1977 | Blunier |
| 4,072,219 | A | 2/1978 | Hahm et al. |
| 4,195,713 | A | 4/1980 | Hagbjer et al. |
| 4,250,950 | A | 2/1981 | Buxmann et al. |
| 4,278,153 | A | 7/1981 | Venkatu |
| 4,338,758 | A | 7/1982 | Hagbjer |
| 4,379,501 | A | 4/1983 | Hagiwara et al. |
| 4,475,634 | A | 10/1984 | Flaim et al. |

(Continued)

FOREIGN PATENT DOCUMENTS

| | | | |
|---|---|---|---|
| CH | 428319 | A | 1/1967 |

(Continued)

OTHER PUBLICATIONS

Chinese First Office Action; CN200510113784.X; Dated May 18, 2007; 19 pages.

(Continued)

*Primary Examiner* — Kevin P Kerns
(74) *Attorney, Agent, or Firm* — Reising Ethington P.C.

(57) ABSTRACT

A method of making a frictionally damped part including providing a frictional damping insert including downwardly extending support legs stamped out of a body portion of the insert.

18 Claims, 5 Drawing Sheets

U.S. PATENT DOCUMENTS

| | | | | |
|---|---|---|---|---|
| 4,523,666 | A | 6/1985 | Murray | |
| 4,529,079 | A | 7/1985 | Albertson | |
| 4,905,299 | A | 2/1990 | Ferraiuolo et al. | |
| 5,004,078 | A | 4/1991 | Oono et al. | |
| 5,025,547 | A | 6/1991 | Sheu et al. | |
| 5,083,643 | A | 1/1992 | Hummel et al. | |
| 5,115,891 | A | 5/1992 | Raitzer et al. | |
| 5,139,117 | A | 8/1992 | Melinat | |
| 5,143,184 | A | 9/1992 | Snyder et al. | |
| 5,183,632 | A | 2/1993 | Kiuchi et al. | |
| 5,184,662 | A | 2/1993 | Quick et al. | |
| 5,259,486 | A | 11/1993 | Deane | |
| 5,310,025 | A | 5/1994 | Anderson | |
| 5,416,962 | A | 5/1995 | Passarella | |
| 5,417,313 | A | 5/1995 | Matsuzaki et al. | |
| 5,509,510 | A | 4/1996 | Ihm | |
| 5,530,213 | A | 6/1996 | Hartsock et al. | |
| 5,582,231 | A | 12/1996 | Siak et al. | |
| 5,620,042 | A | 4/1997 | Ihm | |
| 5,660,251 | A | 8/1997 | Nishizawa et al. | |
| 5,789,066 | A | 8/1998 | DeMare et al. | |
| 5,819,882 | A | 10/1998 | Reynolds et al. | |
| 5,855,257 | A | 1/1999 | Wickert et al. | |
| 5,862,892 | A | 1/1999 | Conley | |
| 5,878,843 | A | 3/1999 | Saum | |
| 5,927,447 | A | 7/1999 | Dickerson | |
| 5,965,249 | A | 10/1999 | Sutton et al. | |
| 6,047,794 | A | 4/2000 | Nishizawa | |
| 6,073,735 | A | 6/2000 | Botsch et al. | |
| 6,112,865 | A | 9/2000 | Wickert et al. | |
| 6,206,150 | B1 | 3/2001 | Hill | |
| 6,216,827 | B1 | 4/2001 | Ichiba et al. | |
| 6,223,866 | B1 | 5/2001 | Giacomazza | |
| 6,231,456 | B1 | 5/2001 | Rennie et al. | |
| 6,241,055 | B1 | 6/2001 | Daudi | |
| 6,241,056 | B1 | 6/2001 | Cullen et al. | |
| 6,283,258 | B1 | 9/2001 | Chen et al. | |
| 6,302,246 | B1 | 10/2001 | Naumann et al. | |
| 6,357,557 | B1 | 3/2002 | DiPonio | |
| 6,405,839 | B1 | 6/2002 | Ballinger et al. | |
| 6,465,110 | B1 | 10/2002 | Boss et al. | |
| 6,481,545 | B1 | 11/2002 | Yano et al. | |
| 6,505,716 | B1 | 1/2003 | Daudi et al. | |
| 6,507,716 | B2 | 1/2003 | Nomura et al. | |
| 6,543,518 | B1 | 4/2003 | Bend et al. | |
| 6,648,055 | B1 | 11/2003 | Haug et al. | |
| 6,799,664 | B1 | 10/2004 | Connolly | |
| 6,880,681 | B2 | 4/2005 | Koizumi et al. | |
| 6,890,218 | B2 | 5/2005 | Patwardhan et al. | |
| 6,899,158 | B2 | 5/2005 | Matuura et al. | |
| 6,932,917 | B2 | 8/2005 | Golden et al. | |
| 6,945,309 | B2 | 9/2005 | Frait et al. | |
| 7,066,235 | B2 | 6/2006 | Huang | |
| 7,112,749 | B2 | 9/2006 | DiPaola et al. | |
| 7,178,795 | B2 | 2/2007 | Huprikar et al. | |
| 7,293,755 | B2 | 11/2007 | Miyahara et al. | |
| 7,594,568 | B2 | 9/2009 | Hanna et al. | |
| 7,604,098 | B2 | 10/2009 | Dessouki et al. | |
| 7,644,750 | B2 | 1/2010 | Schroth et al. | |
| 7,775,332 | B2 * | 8/2010 | Hanna et al. | 188/218 XL |
| 7,836,938 | B2 * | 11/2010 | Agarwal et al. | 164/100 |
| 7,937,819 | B2 * | 5/2011 | Hanna et al. | 29/458 |
| 2002/0084156 | A1 | 7/2002 | Ballinger et al. | |
| 2002/0104721 | A1 | 8/2002 | Schaus et al. | |
| 2003/0037999 | A1 | 2/2003 | Tanaka et al. | |
| 2003/0127297 | A1 | 7/2003 | Smith et al. | |
| 2003/0141154 | A1 | 7/2003 | Rancourt et al. | |
| 2003/0213658 | A1 | 11/2003 | Baba | |
| 2004/0031581 | A1 | 2/2004 | Herreid et al. | |
| 2004/0045692 | A1 | 3/2004 | Redemske | |
| 2004/0074712 | A1 | 4/2004 | Quaglia et al. | |
| 2004/0084260 | A1 | 5/2004 | Hoyte et al. | |
| 2004/0242363 | A1 | 12/2004 | Kohno et al. | |
| 2005/0011628 | A1 | 1/2005 | Frait et al. | |
| 2005/0150222 | A1 | 7/2005 | Kalish et al. | |
| 2005/0183909 | A1 | 8/2005 | Rau, III et al. | |
| 2005/0193976 | A1 | 9/2005 | Suzuki et al. | |
| 2006/0076200 | A1 * | 4/2006 | Dessouki et al. | 188/218 XL |
| 2006/0243547 | A1 | 11/2006 | Keller | |
| 2007/0039710 | A1 | 2/2007 | Newcomb | |
| 2007/0056815 | A1 | 3/2007 | Hanna et al. | |
| 2007/0062664 | A1 | 3/2007 | Schroth et al. | |
| 2007/0062768 | A1 | 3/2007 | Hanna et al. | |
| 2007/0142149 | A1 | 6/2007 | Kleber | |
| 2007/0166425 | A1 | 7/2007 | Utsugi | |
| 2007/0235270 | A1 | 10/2007 | Miskinis et al. | |
| 2007/0298275 | A1 | 12/2007 | Carter et al. | |
| 2008/0099289 | A1 | 5/2008 | Hanna et al. | |
| 2008/0185249 | A1 | 8/2008 | Schroth et al. | |
| 2009/0020256 | A1 * | 1/2009 | Hanna et al. | 164/75 |
| 2009/0032569 | A1 | 2/2009 | Sachdev et al. | |
| 2009/0107787 | A1 * | 4/2009 | Walker et al. | 188/381 |

FOREIGN PATENT DOCUMENTS

| | | | |
|---|---|---|---|
| CN | 2005/10113784.X | | 10/2005 |
| CN | 1757948 | A | 4/2006 |
| CN | 2863313 | Y | 1/2007 |
| DE | 24 46 938 | | 4/1976 |
| DE | 25 37 038 | | 3/1977 |
| DE | 19649919 | A1 | 6/1998 |
| DE | 199 48 009 | | 3/2001 |
| DE | 60000008 | T2 | 3/2002 |
| DE | 101 41 698 | | 3/2003 |
| DE | 102005048258.9 | | 10/2005 |
| DE | 60116780 | T2 | 11/2006 |
| EP | 0 205 713 | | 12/1986 |
| GB | 1230 274 | | 4/1971 |
| JP | 57154533 | | 9/1982 |
| JP | 1126434 | U1 | 8/1989 |
| JP | 05104567 | | 4/1993 |
| JP | 11-342461 | A * | 12/1999 |
| JP | 11342461 | | 12/1999 |
| JP | 2003214465 | A | 7/2003 |
| JP | 2004011841 | A | 1/2004 |
| KR | 20010049837 | A | 6/2001 |
| WO | WO 98/23877 | | 6/1998 |
| WO | WO 01/36836 | | 5/2001 |
| WO | 2007035206 | A2 | 3/2007 |

OTHER PUBLICATIONS

Chinese Second Office Action; CN200510113784.X; Dated Feb. 15, 2008; 13 pages.

German Examination Report; DE102005048258.9-12; Dated Oct. 22, 2007; 8 pages.

Gerdemann, Steven J,; Titanium Process Technologies; Advanced Materials & Processes, Jul. 2001, pp. 41-43.

Mahoney, M. W. & Lynch S. P.; Friction-Stir Processing; 15 pages.

MPIF: All You Need to Know about Powder Metallurgy; http://www.mpif.org/IntroPM/intropm/asp?linkid=1; 8 pages, print date Jun. 23, 2008.

Powder Metallurgy—Wikipedia article; http://en.wikipedia.org/wiki/Powder_metallurgy; 5 pages, print date Jun. 19, 2008.

Sintering—Wikipedia article; http://en.wikipedia.org/wiki/Sintering; 2 pages, print date Jun. 19, 2008.

Magnetorheological fluid—Wikipedia article; http:en/wikipedia.org/wiki/Magnetorheological_fluid, print date Nov. 6, 2007.

PCT/US2009/039839 Written Opinion and Search Report; Date of Mailing: Nov. 24, 2009; 7 pages.

PCT/US2009/048424 Written Opinion and Search Report; Date of Mailing; Dec. 28, 2009; 7 pages.

U.S. Appl. No. 12/328,989, filed Dec. 5, 2008; First Named Inventor: Patrick J. Monsere.

U.S. Appl. No. 12/420,259, filed Apr. 8, 2009; First Named Inventor: Michael D. Hanna.

U.S. Appl. No. 12/434,057, filed May 1, 2009; First Named Inventor: Chongmin Kim.

U.S. Appl. No. 12/436,830, filed May 7, 2009; First Named Inventor: James G. Schroth.

U.S. Appl. No. 12/489,901, filed Jun. 23, 2009; First Named Inventor: Michael D. Hanna.

U.S. Appl. No. 12/885,813, filed Sep. 20, 2010; First Named Inventor: Michael D. Hanna.

International Search Report and Written Opinion mailed Aug. 3, 2009 for International Application No. PCT/US2008/087354, filed Dec. 18, 2008; Applicant: GM Global Technology Operations, Inc., 9 pages.
Dessouki et al., U.S. Appl. No. 10/961,813, Coulumb friction damped disc brake rotors, filed Oct. 8, 2004.
Hanna et al., U.S. Appl. No. 11/475,756, Bi-metal disc brake rotor and method of manufacturing, filed Jun. 27, 2006.
Schroth et al., U.S. Appl. No. 11/475,759, Method of casting components with inserts for noise reduction, filed Jun. 27, 2006.
Schroth et al., U.S. Appl. No. 12/025,967, Damped products and methods of making and using the same, filed Feb. 5, 2008.
Hanna et al., U.S. Appl. No. 11/440,916, Bi-metal disc brake rotor and method of manufacture, filed May 25, 2006.
Hanna et al., U.S. Appl. No. 11/554,234, Coulomb damped disc brake rotor and method of manufacturing, filed Oct. 30, 2006.
Walker et al., U.S. Appl. No. 11/926,798, Inserts with holes for damped products and methods of making and using the same, filed Oct. 29, 2007.
Hanna et al., U.S. Appl. No. 11/832,401, Damped product with insert and method of making the same, filed Aug. 1, 2007.
Kleber, et al., U.S. Appl. No. 11/848,732, Cast-in-place torsion joint, filed Aug. 31, 2007.
Hanna et al., U.S. Appl. No. 11/780,679, Method of manufacturing a damped part, filed Jul. 20, 2007.
Hanna et al., U.S. Appl. No. 12/165,729, Method for securing an insert in the manufacture of a damped part, filed Jul. 1, 2008.
Hanna et al., U.S. Appl. No. 12/165,731, Product with metallic foam and method of manufacturing the same, filed Jul. 1, 2008.
Agarwal et al., U.S. Appl. No. 11/860,049, Insert with tabs and damped products and methods of making the same, filed Sep. 24, 2007.
Hanna et al., U.S. Appl. No. 12/174,163, Damped part, filed Jul. 16, 2008.
Hanna et al., U.S. Appl. No. 12/174,223, Method of casting damped part with insert, filed Jul. 16, 2008.
Hanna et al., U.S. Appl. No. 12/183,180, Casting noise-damped, vented brake rotors with embedded inserts, filed Jul. 31, 2008.
Hanna et al., U.S. Appl. No. 12/183,104, Low mass multi-piece sound damped article, filed Jul. 31, 2008.
Golden et al., U.S. Appl. No. 12/105,411, Insert with filler to dampen vibrating components, filed Apr. 18, 2008.
Hanna et al., U.S. Appl. No. 11/440,893, Rotor assembly and method, filed May 25, 2006.
Carter, U.S. Appl. No. 11/680,179, Damped automotive components with cast in place inserts and method of making same, filed Feb. 28, 2007.
Ulicny et al., U.S. Appl. No. 12/105,438, Filler material to dampen vibrating components, filed Apr. 18, 2008.
Hanna et al., U.S. Appl. No. 12/272,164, Surface configurations for damping inserts, filed Nov. 17, 2008.
Hanna et al., U.S. Appl. No. 12/145,169, Damped product with an insert having a layer including graphite thereon and methods of making and using the same, filed Jun. 24, 2008.
Lowe et al., U.S. Appl. No. 12/174,320, Damped part with insert, filed Jul. 16, 2008.
Xia, U.S. Appl. No. 12/858,596, Lightweight brake rotor and components with composite materials, filed Sep. 20, 2007.
Dessouki et al., U.S. Appl. No. 12/178,872, Friction damped brake drum, filed Jul. 24, 2008.
Sachdev et al., U.S. Appl. No. 11/832,356, Friction welding method and products made using the same, filed Aug. 1, 2007.

* cited by examiner

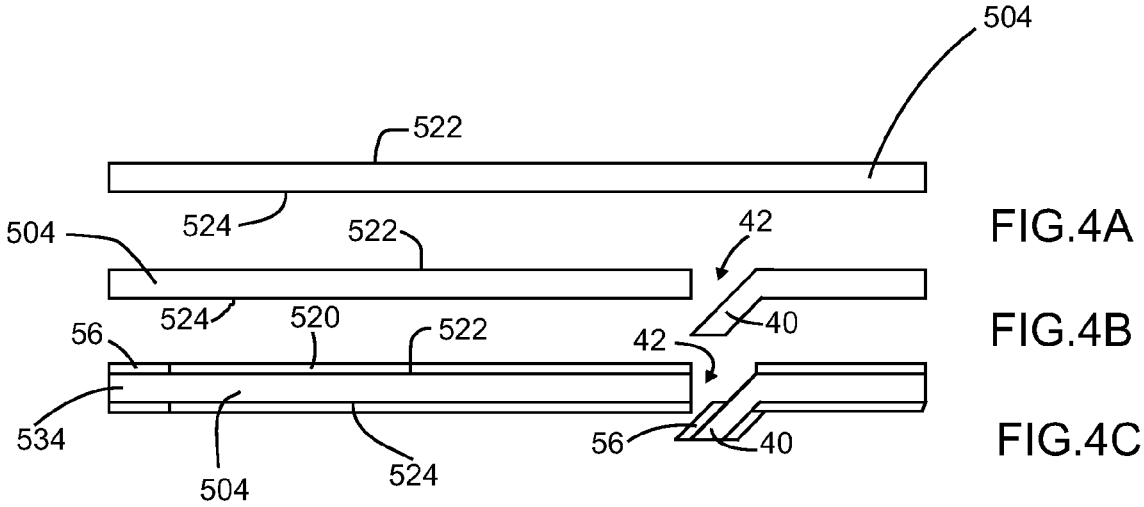
504
522
524
FIG.4A
504
522
42
524
520
522
40
FIG.4B
56
42
534
504
524
56
40
FIG.4C
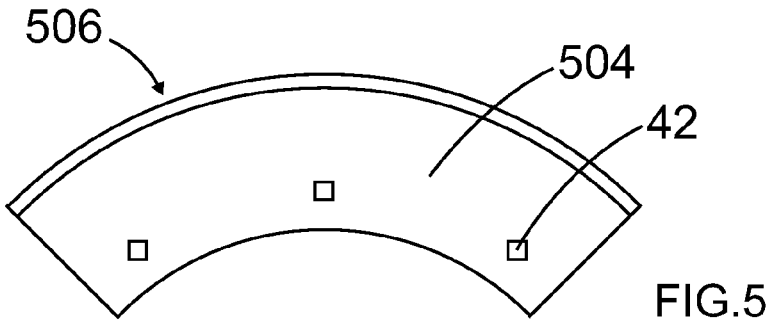
506
504
42
FIG.5

METHOD OF FORMING CASTING WITH FRICTIONAL DAMPING INSERT

TECHNICAL FIELD

The field to which the disclosure generally relates includes methods of making castings with frictional damping inserts and products therefrom.

BACKGROUND

FIG. 1 illustrates a product 10, which in this case is a brake rotor having a hub portion 12 and a rotor cheek portion 14. The rotor cheek portion 14 may include an upper surface 16 and an opposite lower surface 18 each for engagement with associated brake pads. The rotor cheek portion 14 may include one or more frictional damping inserts 20, 22 therein to reduce or eliminate unwanted vibration or noise produced by vibrating the rotor cheek. In most instances, it is desirable for the inserts 20, 22 to be parallel with the upper surface 16 and lower surface 18 of the rotor cheek 14.

FIG. 2 illustrates a poor quality casting wherein the inserts 20, 22 have been moved during the casting and solidification process. As such, the inserts 20 and 22 are no longer parallel to the upper surface 16 and lower surface 18 of the rotor cheek 14.

SUMMARY OF EXEMPLARY EMBODIMENTS OF THE INVENTION

One embodiment of the invention includes a method of making a product comprising providing a frictional damping insert including a downwardly extending leg stamped out of a flat planar portion of the insert, and placing the insert in a casting mold so that the downwardly extending legs support the insert in the casting mold, closing the casting mold and casting a molten metal into the mold and solidifying the same.

Other exemplary embodiments of the invention will become apparent from the detailed description provided hereinafter. It should be understood that the detailed description and specific examples, while disclosing exemplary embodiments of the invention, are intended for purposes of illustration only and are not intended to limit the scope of the invention.

BRIEF DESCRIPTION OF THE DRAWINGS

Exemplary embodiments of the invention will become more fully understood from the detailed description and the accompanying drawings, wherein:

FIGS. 4A-C illustrate first, second and third steps respectively of making a frictional damping insert for a casting method according to one embodiment of the invention.

FIG. 5 is a plan view with portions broken away of a casting including a frictional damping insert with support legs according to one embodiment of the invention.

DETAILED DESCRIPTION OF EXEMPLARY EMBODIMENTS

The following description of the embodiment(s) is merely exemplary in nature and is in no way intended to limit the invention, its application, or uses.

Figure 1:
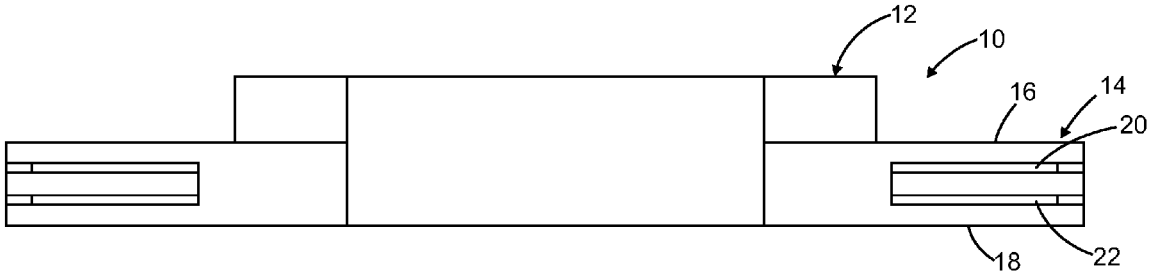
FIG.1 PRIOR ART
FIG. 1 illustrates a prior art product including a casting having a frictional damping insert properly positioned in the casting.
Figure 2:
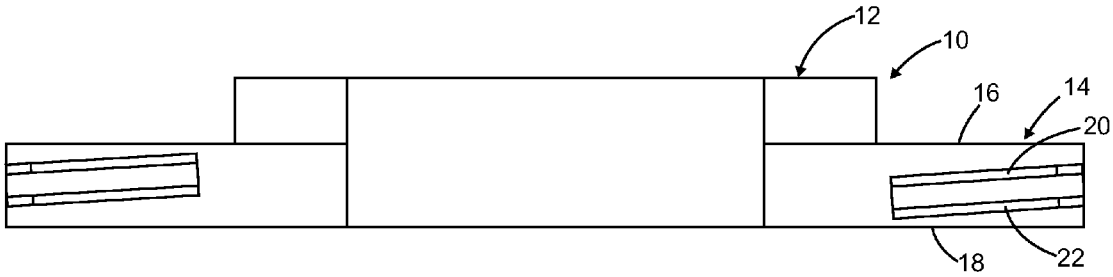
FIG.2 PRIOR ART
FIG. 2 illustrates a prior art poor quality casting wherein the insert has moved during the casting and solidifying process.
Figure 3:
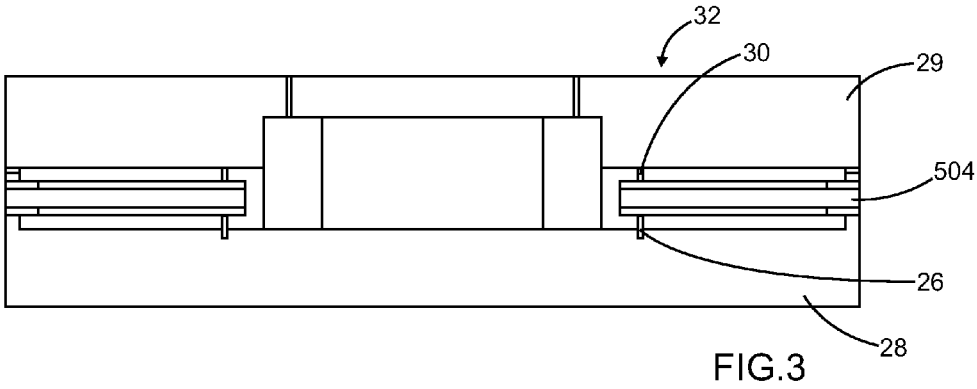
FIG. 3 illustrates a method of making a casting including the use of support legs according to one embodiment of the invention.

Referring now to FIG. 3, one embodiment of the invention includes a method of casting a product including a frictional damping insert 504 supported by support leg 26 and optionally positioning leg 30 to position the insert 504 in a casting mold 32. The casting mold 32 may include a lower portion 28 and an upper portion 29. The legs 26 and 30 may be in the form of dowels that may be made from metal ceramic or any other suitable material.

Referring now to FIGS. 4A-C, one embodiment of the invention includes providing a substrate, which may be a frictional damping insert 504. In a preferred embodiment the frictional damping insert is a metal substrate, such as, but not limited to, a ferrous alloy. As shown in FIG. 4B, thereafter, a downwardly extending leg 40 is stamped out of the insert 504. The leg 40 may be stamped out of the insert 504 before or after a coating 520 may be optionally placed on the insert 504. As shown in FIG. 4C, a coating 520 may be deposited over at least portions of the outer surfaces 522, 524 of the insert 504. The coating 520 prevents the molten metal during the casting process from wetting the insert 504 and bonding thereto. The insert 504 may be constructed and arranged to optionally provide a tab 534 as will be described in greater detail hereafter. The tab 534 and the downwardly extending leg 40 may be kept free with the coating 520 for example by masking the leg 40, or the coating 520 may be removed. Alternatively, a coating 56 such as graphite may be applied to the downwardly extending leg 40 and/or the tab 543 to allow the molten metal to wet those portions of the insert and bond thereto. A through-hole 42 may be formed in the insert 504 as a result of the step of stamping the leg 40 out of the insert 504.

FIG. 5 is a plan view of a section of a disc brake rotor including a frictional damping insert 504 showing through-holes 42 associated with a leg 40 stamped out of the insert and a surrounding body portion 506 of the rotor.

Figure 6:
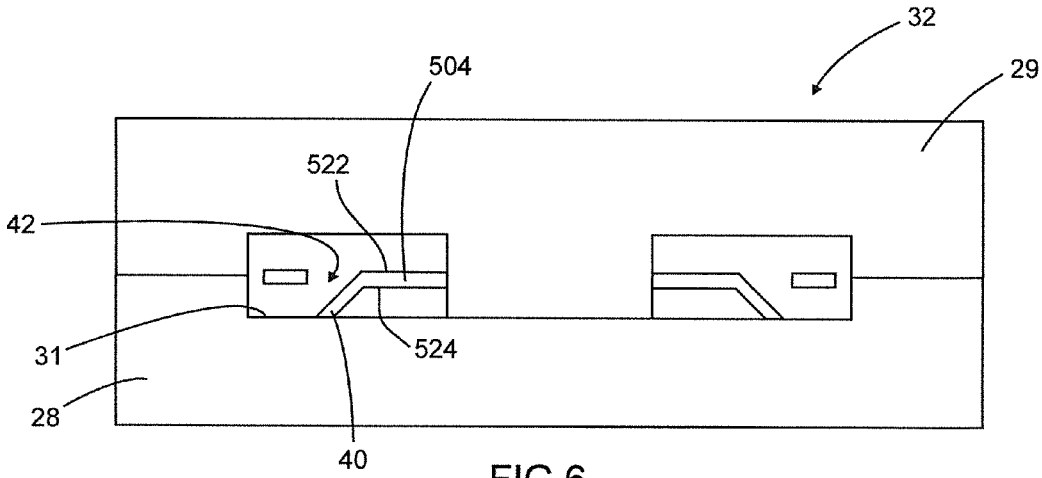
FIG. 6 illustrates a method of using a frictional damping insert having a downwardly extending leg according to one embodiment of the invention.

FIG. 6 illustrates a method of casting a part by placing a frictional damping insert in a lower half 28 of a mold 32 so that the downwardly extending leg 40 of the insert 504 engages the floor 31 of the lower half 28 that defines (in part) a cavity of the mold 32. Thereafter, the upper half 27 of the mold is closed and molten metal is cast into the mold to surround at least a portion of the outer surfaces 522, 524 of the insert 504.

Figure 7:
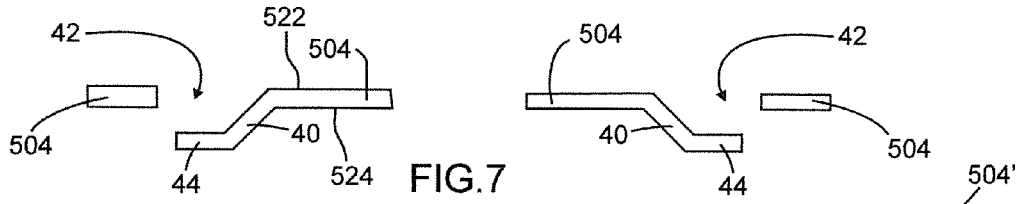
FIG. 7 illustrates another embodiment of a frictional damping insert including a downwardly extending leg and a foot according to one embodiment of the invention.

FIG. 7 illustrates another embodiment of a frictional damping insert 504 including a downwardly extending leg portion 40 and an attached foot portion 44 which is stamped out of the insert 504. Preferably, the foot portion 44 is bent to be substantially parallel with the main body portion of the insert 504. The foot portion 44 may be helpful in preventing the downwardly extending leg portion 40 from digging into the lower half 28 of the mold 32.

Figure 8:
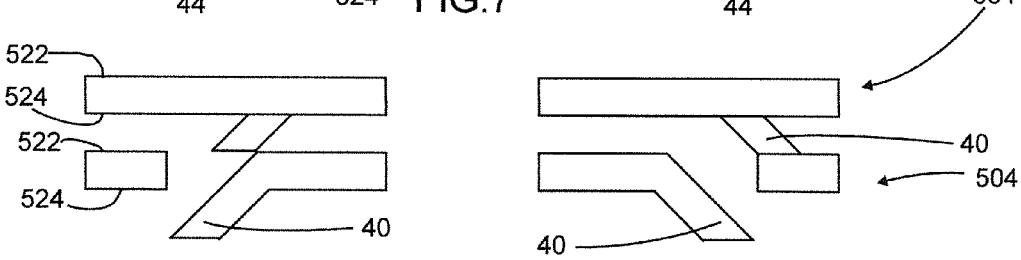
FIG. 8 illustrates a method of casting a part including stacked frictional damping inserts each including a plurality of downwardly extending support legs.

FIG. 8 illustrates a method of making a product including stacking two frictional damping inserts 504 on top of each other including a lower insert 504 which is placed in the lower half 28 of the mold 32 and the second insert 504 is placed on top of the first insert so that a downwardly extending leg 40 of the second insert engages the first insert to support the main body portion of the second insert in a spaced apart position with respect to the main body portion of the first insert.

Figure 9:
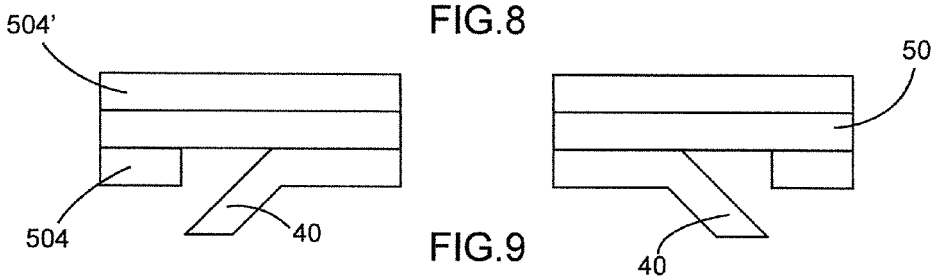
FIG. 9 illustrates a method of making a vented brake rotor including a first frictional damping insert having a downwardly extending support leg, a core overlying the first insert and a second frictional damping insert overlying the core.

FIG. 9 illustrates a method of making a vented brake rotor according to one embodiment of the invention, including providing a first frictional damping insert 504 including a downwardly extending leg 40 stamped out of the first insert 504. A core 50 is placed over the first insert 504 which may include through-holes formed therein into which molten metal will flow and solidify to provide vanes extending between first and second rotor cheek portions of the vented rotor. In one embodiment, the core 50 may be a sacrificial core that may be removed by etch, dissolving, drill or machining the core 50. A second frictional damping insert 504' may be placed on top of the core 50. The second frictional damping insert 504 need not include the downwardly extending leg portion 40. The inserts 504, 504' and core 50 as shown in FIG. 9 may be placed in a casting mold 32 as shown in FIG. 9 to produce a damped vented brake rotor.

Details of the frictional damping insert 504 are provided hereafter.

Referring to FIGS. 10-18, one embodiment of the invention includes a product or part 500 having a frictional damping means. The frictional damping means may be used in a variety of applications including, but not limited to, applications where it is desirable to reduce noise associated with a vibrating part or reduce the vibration amplitude and/or duration of a part that is struck, dynamically loaded, excited, or set in motion. In one embodiment the frictional damping means may include an interface boundary conducive to frictionally damping a vibrating part. In one embodiment the damping means may include frictional surfaces 502 constructed and arranged to move relative to each other and in frictional contact, so that vibration of the part is dissipated by frictional damping due to the frictional movement of the surfaces 502 against each other.

According to various illustrative embodiments of the invention, frictional damping may be achieved by the movement of the frictional surfaces 502 against each other. The movement of frictional surfaces 502 against each other may include the movement of: surfaces of the body 506 of the part against each other; a surface of the body 506 of the part against a surface of the insert 504; a surface of the body 506 of the part against the layer 520; a surface of the insert 504 against the layer 520; a surface of the body 506 of the part against the particles 514 or fibers; a surface of the insert 504 against the particles 514 or fibers; or by frictional movement of the particles 514 or fibers against each other or against remaining binder material.

In embodiments wherein the frictional surface 502 is provided as a surface of the body 506 or the insert 504 or a layer 520 over one of the same, the frictional surface 502 may have a minimal area over which frictional contact may occur that may extend in a first direction a minimum distance of 0.1 mm and/or may extend in a second (generally traverse) direction a minimum distance of 0.1 mm. In one embodiment the insert 504 may be an annular body and the area of frictional contact on a frictional surface 502 may extend in an annular direction a distance ranging from about 20 mm to about 1000 mm and in a transverse direction ranging from about 10 mm to about 75 mm. The frictional surface 502 may be provided in a variety of embodiments, for example, as illustrated in FIGS. 10-18.

Referring again to FIG. 10, in another embodiment of the invention one or more of the outer surfaces 522, 524 of the insert 504 or surfaces 526, 528 of the body 506 of the part 500 may include a relatively rough surface including a plurality of peaks 510 and valleys 512 to enhance the frictional damping of the part. In one embodiment, the surface of the insert 504 or the body 506 may be abraded by sandblasting, glass bead blasting, water jet blasting, chemical etching, machining or the like.

Figure 10:
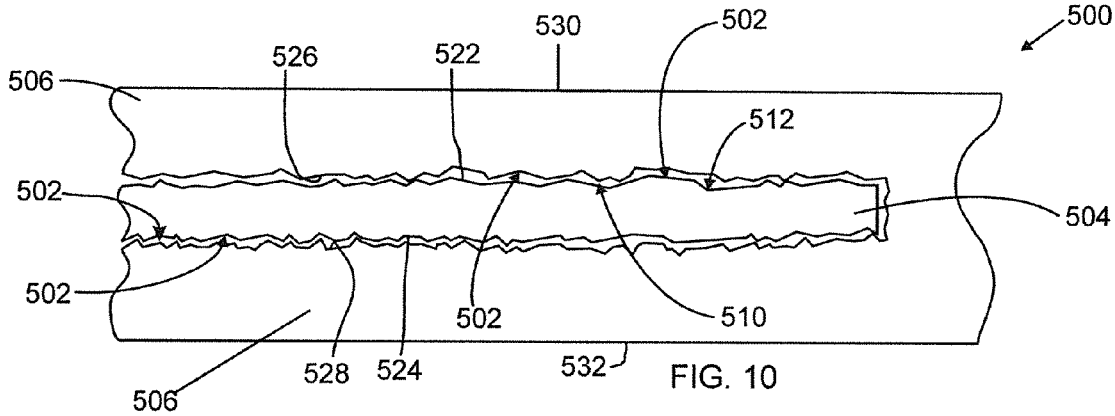
FIG. 10 is a sectional view with portions broken away of one embodiment of the invention including an insert.
Figure 13:
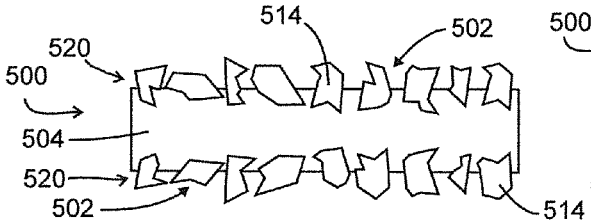
FIG. 13 is an enlarged view of one embodiment of the invention.
Figure 14:
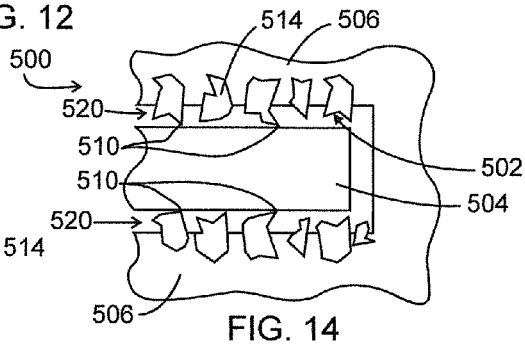
FIG. 14 is a sectional view with portions broken away of one embodiment of the invention.

In another embodiment of the invention the damping means or frictional surface 502 may be provided by particles 514 or fibers provided on at least one face of the insert 504 or a surface of the body 506 of the part 500. The particles 514 may have an irregular shape (e.g., not smooth) to enhance frictional damping, as illustrated in FIG. 10. One embodiment of the invention may include a layer 520 including the particles 514 or fibers which may be bonded to each other or to a surface of the body 506 of the part or a surface of the insert 504 due to the inherent bonding properties of the particles 514 or fibers. For example, the bonding properties of the particles 514 or fibers may be such that the particles 514 or fibers may bind to each other or to the surfaces of the body 506 or the insert 504 under compression. In another embodiment of the invention, the particles 514 or the fibers may be treated to provide a coating thereon or to provide functional groups attached thereto to bind the particles together or attach the particles to at least one of a surface of the body 506 or a surface of the insert 504. In another embodiment of the invention, the particles 514 or fibers may be embedded in at least one of the body 506 of the part or the insert 504 to provide the frictional surface 502 (FIGS. 13-14).

In embodiments wherein at least a portion of the part 500 is manufactured such that the insert 504 and/or the particles 514 or fibers are exposed to the temperature of a molten material such as in casting, the insert 504 and/or particles 514 or fibers may be made from materials capable of resisting flow or resisting significant erosion during the manufacturing. For example, the insert 504 and/or the particles 514 or fibers may include refractory materials capable of resisting flow or that do not significantly erode at temperatures above 1100° F., above 2400° F., or above 2700° F. When molten material, such as metal, is cast around the insert 504 and/or the particles 514, the insert 504 or the particles 514 should not be wet by the molten material so that the molten material does not bond to the insert 504 or layer 520 at locations wherein a frictional surface 502 for providing frictional damping is desired.

Illustrative examples of suitable particles 514 or fibers include, but are not limited to, particles or fibers including silica, alumina, graphite with clay, silicon carbide, silicon nitride, cordierite (magnesium-iron-aluminum silicate), mullite (aluminum silicate), zirconia (zirconium oxide), phyllosilicates, or other high-temperature-resistant particles. In one embodiment of the invention the particles 514 may have a length along the longest dimension thereof ranging from about 1 μm-350 μm, or 10 μm-250 μm.

In another embodiment of the invention, the layer 520 may be a coating over the body 506 of the part or the insert 504. The coating may include a plurality of particles 514 which may be bonded to each other and/or to the surface of the body 506 of the part or the insert 504 by an inorganic or organic binder 516 (FIGS. 11-12, 17) or other bonding materials. Illustrative examples of suitable binders include, but are not limited to, epoxy resins, phosphoric acid binding agents, calcium aluminates, sodium silicates, wood flour, or clays. In another embodiment of the invention the particles 514 may be held together and/or adhered to the body 506 or the insert 504 by an inorganic binder. In one embodiment, the coating may be deposited on the insert 504 or body 506 as a liquid dispersed mixture of alumina-silicate-based, organically bonded refractory mix.

In another embodiment, the coating may include at least one of alumina or silica particles, mixed with a lignosulfonate binder, cristobalite ($SiO_2$), quartz, or calcium lignosulfonate. The calcium lignosulfonate may serve as a binder. In one embodiment, the coating may include IRONKOTE. In one embodiment, a liquid coating may be deposited on a portion of the insert and may include any high temperature ceramic coating, such as but not limited to, LADLE KOTE 310B. In another embodiment, the coating may include at least one of clay, $Al_2O_3$, $SiO_2$, a graphite and clay mixture, silicon carbide, silicon nitride, cordierite (magnesium-iron-aluminum silicate), mullite (aluminum silicate), zirconia (zirconium oxide), or phyllosilicates. In one embodiment, the coating may comprise a fiber such as ceramic or mineral fibers.

When the layer 520 including particles 514 or fibers is provided over the insert 504 or the body 506 of the part the thickness L (FIG. 11) of the layer 520, particles 514 and/or fibers may vary. In various embodiments, the thickness L of the layer 520, particles 514 and/or fibers may range from about 1 μm-400 μm, 10 μm-400 μm, 30 μm-300 μm, 30 μm-40 μm, 40 μm-100 μm, 100 μm-120 μm, 120 μm-200 μm, 200 μm-300 μm, 200 μm-250 μm, or variations of these ranges.

In yet another embodiment of the invention the particles 514 or fibers may be temporarily held together and/or to the surface of the insert 504 by a fully or partially sacrificial coating. The sacrificial coating may be consumed by molten metal or burnt off when metal is cast around or over the insert 504. The particles 514 or fibers are left behind trapped between the body 506 of the cast part and the insert 504 to provide a layer 520 consisting of the particles 514 or fibers or consisting essentially of the particles 514 or fibers.

Figure 11:
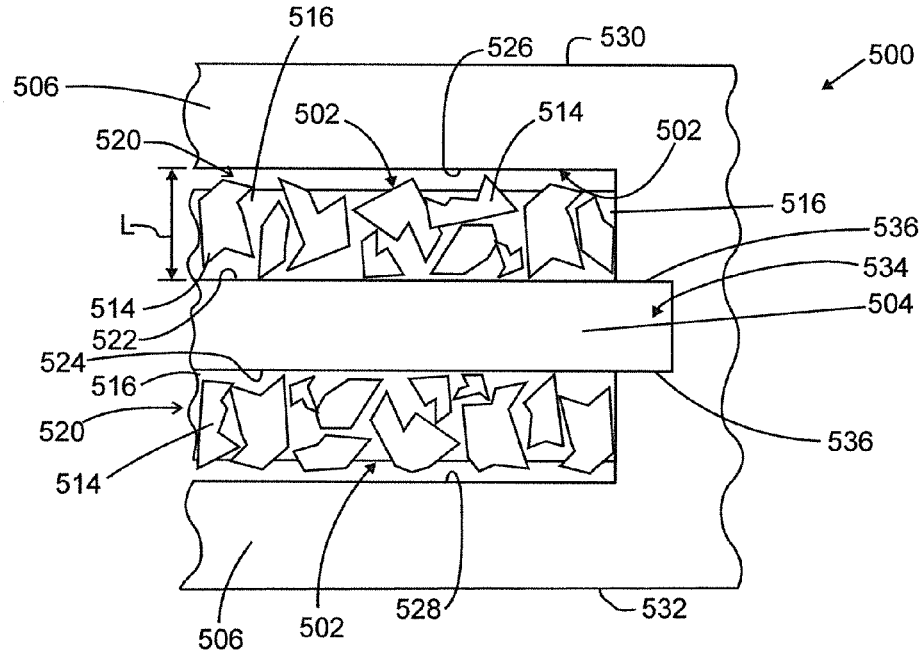
FIG. 11 is a sectional view with portions broken away of one embodiment of the invention including an insert having a layer thereon to provide a frictional surface or damping.
Figure 12:
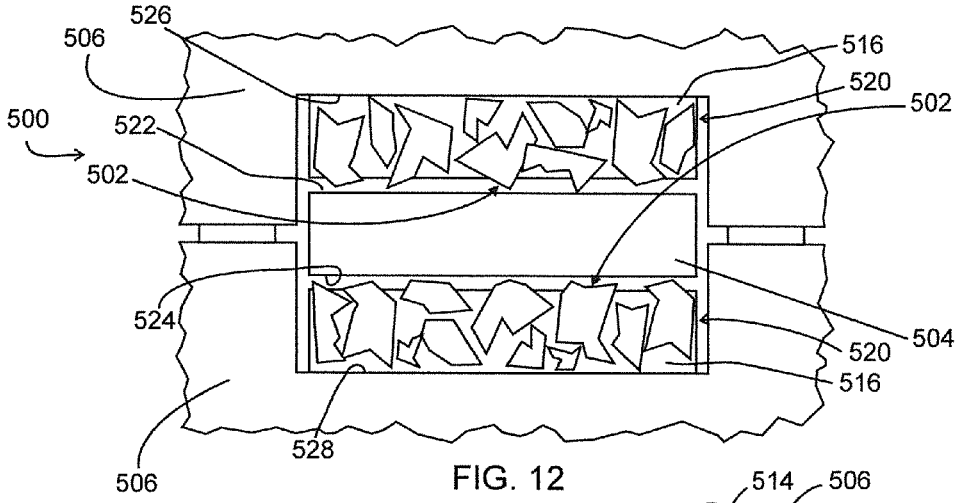
FIG. 12 is a sectional view with portions broken away of one embodiment of the inventions.

The layer 520 may be provided over the entire insert 504 or only over a portion thereof. In one embodiment of the invention the insert 504 may include a tab 534 (FIG. 11). For example, the insert 504 may include an annular body portion and a tab 534 extending radially inward or outward therefrom. In one embodiment of the invention at least one wettable surface 536 of the tab 534 does not include a layer 520 including particles 514 or fibers, or a wettable material such as graphite is provided over the tab 534, so that the cast metal is bonded to the wettable surface 536 to attach the insert 504 to the body 506 of the part 500 but still allow for frictional damping over the remaining insert surface which is not bonded to the casting. However, an insert 504 with the downwardly extending leg 40 can be positioned and supported in a mold without a tab 534 on the insert 504.

In one embodiment of the invention at least a portion of the insert 504 is treated or the properties of the insert 504 are such that molten metal will not wet or bond to that portion of the insert 504 upon solidification of the molten metal. According to one embodiment of the invention at least one of the body 506 of the part or the insert 504 includes a metal, for example, but not limited to, aluminum, titanium, steel, stainless steel, cast iron, any of a variety of other alloys, or metal matrix composite including abrasive particles. In one embodiment of the invention the insert 504 may include a material such as a metal having a higher melting point than the melting point of the molten material being cast around a portion thereof.

In one embodiment the insert 504 may have a minimum average thickness of 0.2 mm and/or a minimum width of 0.1 mm and/or a minimum length of 0.1 mm. In another embodiment the insert 504 may have a minimum average thickness of 0.2 mm and/or a minimum width of 2 mm and/or a minimum length of 5 mm. In other embodiments the insert 504 may have a thickness ranging from about 0.1-20 mm, 0.1-6.0 mm, or 1.0-2.5 mm, or ranges therebetween.

Figure 15:
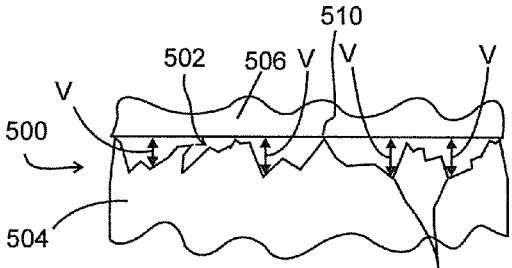
FIG. 15 is an enlarged sectional view with portions broken away of one embodiment of the invention.
Figure 16:
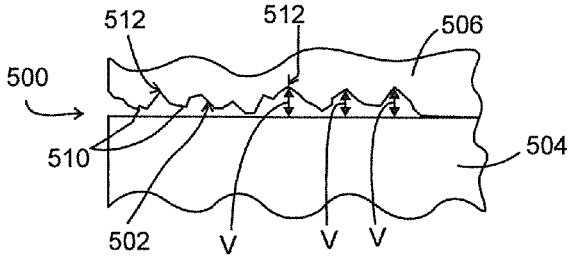
FIG. 16 is an enlarged sectional view with portions broken away of one embodiment of the invention.
Figure 17:
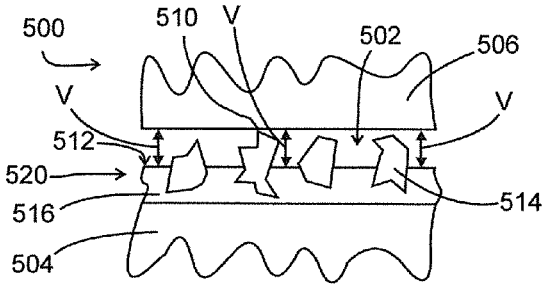
FIG. 17 is an enlarged sectional view with portions broken away of one embodiment of the invention.
Figure 18:
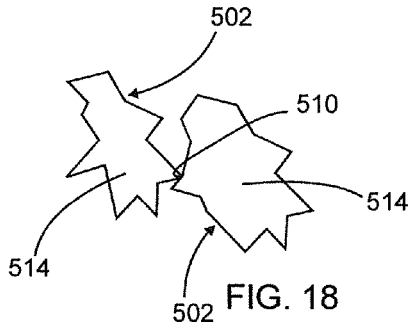
FIG. 18 illustrates one embodiment of the invention.

Referring now to FIGS. 15-17, the frictional surface 502 may have a plurality of peaks 510 and a plurality of valleys 512. The depth as indicated by line V of the valleys 512 may vary with embodiments. In various embodiments, the average of the depth V of the valleys 512 may range from about 1 μm-300 μm, 50 μm-260 μm, 100 μm-160 μm or variations of these ranges. However, for all cases there is local contact between the body 506 and the insert 504 during component operation for frictional damping to occur. In other embodiments of the invention improvements in the frictional damping may be achieved by adjusting the thickness (L, as shown in FIG. 11) of the layer 520 depth of the valleys 512.

In one embodiment the insert 504 is not pre-loaded or under pre-tension or held in place by tension. In one embodiment the insert 504 is not a spring. Another embodiment of the invention includes a process of casting a material comprising a metal around an insert 504 with the proviso that the frictional surface 502 portion of the insert used to provide frictional damping is not captured and enclosed by a sand core that is placed in the casting mold. In various embodiments the insert 504 or the layer 520 includes at least one frictional surface 502 or two opposite friction surfaces 502 that are completely enclosed by the body 506 of the part. In another embodiment the layer 520 including the particles 514 or fibers that may be completely enclosed by the body 506 of the part or completely enclosed by the body 506 and the insert 504, and wherein at least one of the body 506 or the insert 504 comprises a metal or consists essentially of a metal. In one embodiment of the invention the layer 520 and/or insert 504 does not include or is not carbon paper or cloth.

Referring again to FIGS. 10-12, in various embodiments of the invention the insert 504 may include a first face 522 and an opposite second face 524 and the body 506 of the part may include a first inner face 526 adjacent the first face 522 of the insert 504 constructed to be complementary thereto, for example nominally parallel thereto. The body 506 of the part includes a second inner face 528 adjacent to the second face 524 of the insert 504 constructed to be complementary thereto, for example parallel thereto. The body 506 may include a first outer face 530 overlying the first face 522 of the insert 504 constructed to be complementary thereto, for example parallel thereto. The body 506 may include a first outer face 532 overlying the second face 524 of the insert 504 constructed to be complementary thereto, for example parallel thereto. However, in other embodiments of the invention the outer faces 530, 532 of the body 506 are not complementary to associated faces 522, 524 of the insert 504. In other embodiments the surfaces 526 and 528; 526 and 522; or 528 and 524 may be mating surfaces but not parallel to each other.

When the term "over," "overlying," overlies," "under," "underlying," or "underlies" is used herein to describe the relative position of a first layer or component with respect to a second layer or component such shall mean the first layer or component is directly on and in direct contact with the second layer or component or that additional layers or components may be interposed between the first layer or component and the second layer or component.

The above description of embodiments of the invention is merely exemplary in nature and, thus, variations thereof are not to be regarded as a departure from the spirit and scope of the invention.

What is claimed is:

1. A method of making a product comprising:

providing a frictional damping insert including a body portion having a planar portion and a plurality of support legs stamped out of the body portion, the support legs bent and extending downward from the planar portion, the body portion having a plurality of through holes formed therein from the support legs being stamped out of the body portion, and placing the insert in a lower portion of a casting mold so that the downwardly extending legs engage a floor of the lower portion of the casting mold and support the insert in the mold, closing an upper portion of the mold and casting molten metal into the mold to surround at least a portion of the outer surfaces of the frictional damping insert.

2. A method as set forth in claim 1 further comprising providing a second frictional damping insert comprising a body portion and a plurality of downwardly extending support legs stamped out of the body portion and placing the second frictional damping insert on top of the first frictional damping insert so that the downwardly extending support legs of the second insert support the body portion of the second insert in a spaced apart relationship with the body portion of the first insert.

3. A method as set forth in claim 2 further comprising placing a core over the first insert, and placing a second frictional damping insert over the core prior to closing the top portion of the mold.

4. A method as set forth in claim 3 wherein the core includes a plurality of through holes formed therein so that the product comprises a vented brake rotor comprising a plurality of vanes extending between the first insert and second insert.

5. A method as set forth in claim 1 wherein the frictional damping insert includes a coating on a portion thereof to prevent molten metal from wetting the coated portion and bonding thereto.

6. A method as set forth in claim 1 wherein the insert comprises stainless steel.

7. A method as set forth in claim 6 wherein the molten metal is cast iron.

8. A method as set forth in claim 1 wherein the insert includes an annular body portion, and wherein the downwardly extending support legs are stamped from the annular body portion.

9. A method as set forth in claim 8 further comprising support tabs extending radially inward or outward from the annular body portion.

10. A method as set forth in claim 9 wherein the support tabs do not include a coating thereon.

11. A method as set forth in claim 9 wherein the support tabs include a coating thereon to allow the molten metal to wet the tabs and bond thereto.

12. A method as set forth in claim 8 further comprising a coating over portions of the annular body, the coating preventing molten metal from wetting the coated portion of the annular body.

13. A method as set forth in claim 12 wherein the downwardly extending support legs include a different coating thereon to allow molten metal to wet the legs and bond thereto.

14. A method as set forth in claim 1 wherein the downwardly extending support legs do not include a coating thereon.

15. A method as set forth in claim 1 further comprising cooling the molten metal to provide a metal casting, the metal casting surrounding the frictional damping insert.

16. A method as set forth in claim 15 wherein the metal casting comprises a brake rotor cheek and a hub portion.

17. A method as set forth in claim 15 wherein the insert comprises stainless steel and the metal casting comprises cast iron.

18. A method as set forth in claim 15 wherein at least a portion of the insert is not bonded to the metal casting.

* * * * *